United States Patent [19]

Swartzbaugh et al.

[11] Patent Number: 4,527,706

[45] Date of Patent: Jul. 9, 1985

[54] TAMPER INDICATING PACKAGE

[75] Inventors: Peter T. Swartzbaugh, Toledo; Edward M. Hehl, Perrysburg, both of Ohio

[73] Assignee: Owens-Illinois, Inc., Toledo, Ohio

[21] Appl. No.: 579,616

[22] Filed: Feb. 13, 1984

[51] Int. Cl.[3] ..... B65D 45/32

[52] U.S. Cl. ..... 215/252; 215/253

[58] Field of Search ..... 215/252, 253, 258

[56] References Cited

U.S. PATENT DOCUMENTS

| | | | |
|---|---|---|---|
| 2,124,638 | 7/1938 | Sheldon et al. | 215/252 |
| 2,162,712 | 6/1939 | Hamberger | 215/252 |
| 3,199,703 | 8/1965 | Alexander | 215/252 |
| 3,484,012 | 12/1969 | White et al. | 215/252 |
| 3,504,818 | 4/1970 | Crisci et al. | 215/252 |
| 3,650,428 | 3/1972 | Miller | 215/252 |
| 3,924,769 | 12/1975 | Fillmore | 215/253 X |
| 3,980,195 | 9/1976 | Fillmore | 215/252 X |
| 4,225,050 | 9/1980 | Reinhart | 215/252 |
| 4,394,918 | 7/1983 | Grussen | 215/253 X |
| 4,423,820 | 1/1984 | Vangor | 215/252 |

FOREIGN PATENT DOCUMENTS

| | | | |
|---|---|---|---|
| 195624 | 10/1964 | Sweden | 215/252 |

*Primary Examiner*—Steven M. Pollard
*Attorney, Agent, or Firm*—John R. Nelson

[57] ABSTRACT

A tamper indicating package comprising a container having a body portion and a neck portion having external threads thereon and a closure having a top wall and a peripheral skirt having internal threads adapted to engage the threads on the neck of the container. A tamper indicating band extends downwardly from said skirt and an integral weakened portion interconnects the band to the skirt. The container has an annular bead spaced below the threads on the neck and a radially inwardly extending bead adapted to engage the annular bead on the container when the closure is threaded on the container. The annular bead on the container and the radial bead on the tamper indicating band having interengaging portions which are operable during unthreading of the closure to shear the bridge portions.

10 Claims, 9 Drawing Figures

TAMPER INDICATING PACKAGE

This invention relates to tamper indicating packages.

BACKGROUND AND SUMMARY OF THE INVENTION

In the packaging of the various products, it has become common to provide some indication with whether or not the closure has been removed and possibly the contents have been tampered with. Thus, in one type of tamper indicating package that has been used, wherein a closure is threaded on the neck of the container, the skirt of the closure is formed with an integral tamper indicating band connected along a weakened line and the band has a radially inwardly extending bead that snaps over an annular bead on the container. When the closure is unthreaded, the tamper indicating band is severed from the closure along the weakened line to indicate that the closure has been removed and reapplied.

One of the problems with respect to such a closure, is that the force necessary to apply the closure and snap the tamper indicating band portion of the closure over the annular bead of the container is such that the weakened line may be broken during application of the closure.

In order to overcome this problem, it has been proposed to utilize a plurality of circumferentially spaced bridge portions which also interconnect the skirt of the closure and the tamper indicating band. When the closure is applied, the bridge portions absorb the axial force and prevent tearing of the band from the closure. When the threaded closure is unthreaded to remove the closure, the bridge portions are subjected to an axial tension in order to sever them as well as the remaining weakened line and leave the tamper indicating band on the container. Such a construction requires a careful control of the dimensions of the bridges in order to keep the force required to remove the closure to a reasonable value. On the other hand, if the bridge portions and the weakened line are made so thin that they are easily fractured, it is possible for a child to readily remove the closure.

Among the objectives of the present invention are to provide a tamper indicating package that includes strong bridge portions which will permit the application of the closure without damage to the connection of the tamper indicating band to the remainder of the closure; which will deter the ready removal of the closure by children; wherein the closure can be easily made by molding; and wherein a better quality of closure is made possible.

In accordance with the invention, the tamper indicating package comprises a container having a body portion and a neck portion having external threads thereon, the closure has a top wall and a peripheral skirt having internal threads adapted to engage the threads on the neck of the container. A tamper indicating band extends downwardly from the skirt and an integral weakened portion interconnects the band to the skirt. The container has an annular bead spaced below the threads on the neck and the band has a radially inwardly extending bead adapted to engage the annular bead on the container when the closure is threaded on the container. The annular bead on the container and the radial bead on the tamper indicating band have interengaging means which are operable during unthreading of the closure to shear the bridge portions.

DESCRIPTION

Figure 1:
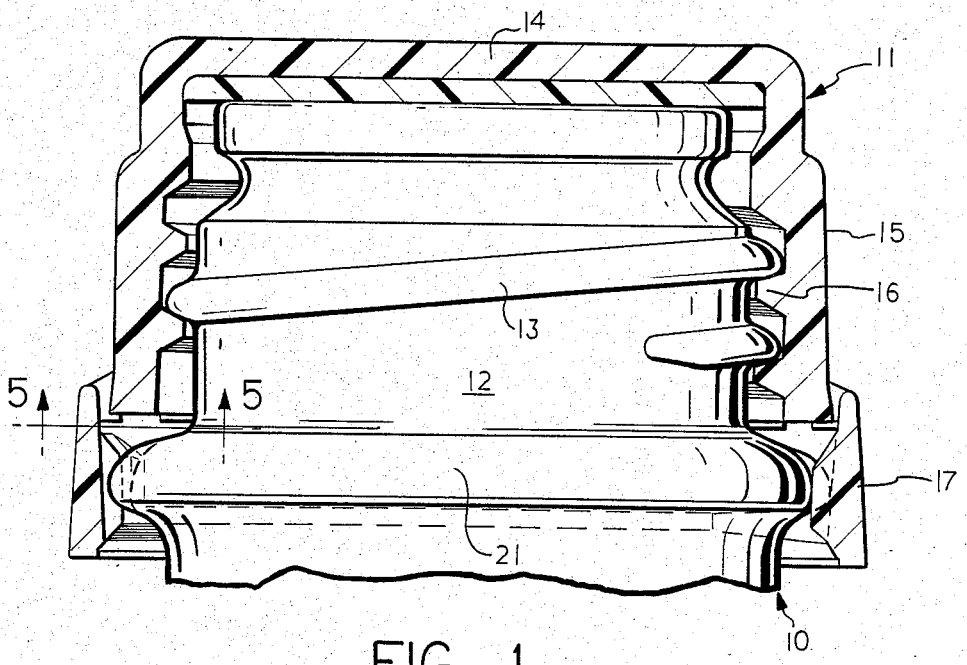
FIG. 1 is a fragmentary vertical sectional view of a tamper indicating package embodying the invention taken along the line 1—1 in FIG. 2.
Figure 3:
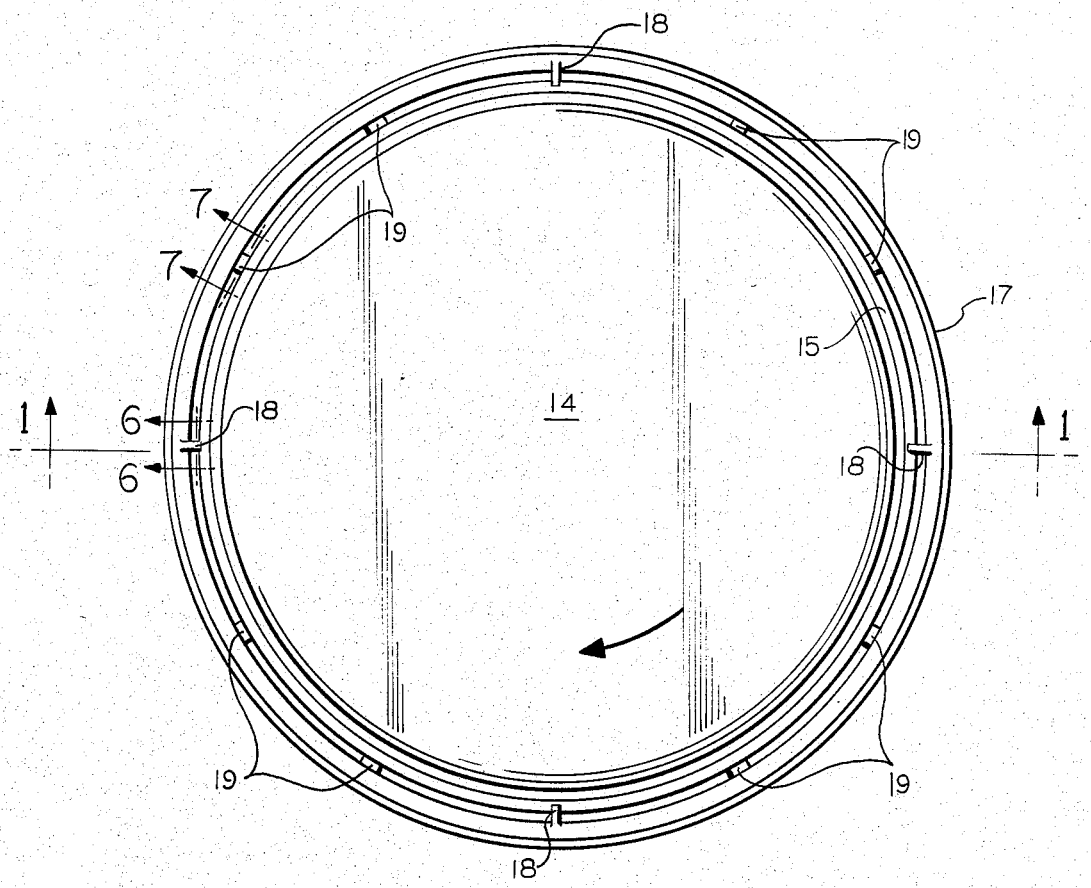
FIG. 3 is a top plan view of the closure.
Figure 2:
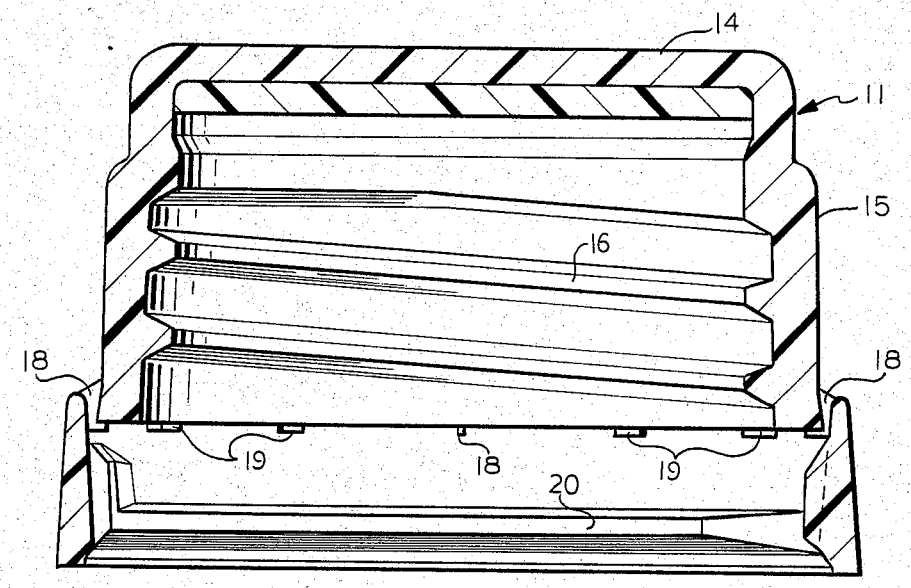
FIG. 2 is a vertical sectional view of the closure forming part of the package taken along the line 2—2 in FIG. 4.

Referring to FIG. 1, the tamper indicating package embodying the invention comprises a container 10 and closure 11. The container 10 may be made of glass or plastic such as propylene. The closure 11 is made of plastic such as propylene. The container 10 includes a body portion and a neck 12 having external threads 13 thereon. The closure 11 includes a top wall 14 and peripheral skirt 15 having internal threads 16 adapted to engage the threads 13 on the neck 12 of the container 10.

Figure 5:
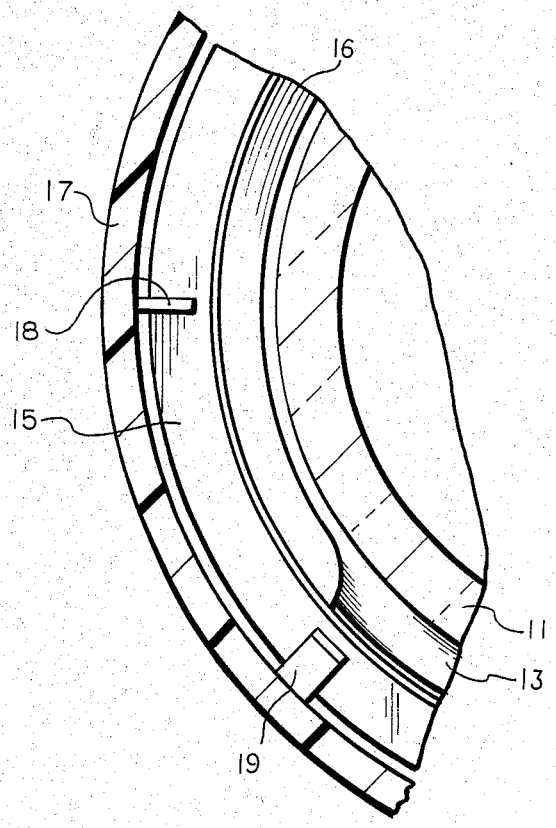
FIG. 5 is a fragmentary sectional view on an enlarged scale taken along the line 5—5 in FIG. 1.
Figure 6:
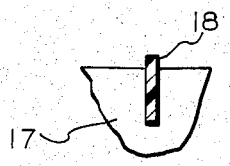
FIG. 6 is a fragmentary sectional view taken along the line 6—6 in FIG. 3.
Figure 7:
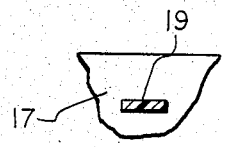
FIG. 7 is a fragmentary sectional view taken along the line 7—7 in FIG. 3.

In accordance with the invention, a tamper indicating band 17 having a greater diameter than skirt 15 is made integral with the skirt 15 of the closure 11 and is connected thereto by a plurality of bridge portions 18, 19. Bridge portion 18 extends radially from the skirt 15 to the upper end of band 17 and has a cross section with greater axial dimension, that is, the bridge portion 18 extends vertically as viewed in FIG. 6. Each bridge portion 19 extends radially from the skirt 15 to the upper end of band 17 and has a cross section with a greater circumferential direction than an axial dimension such that the bridge portion 19 extends horizontally as viewed in FIG. 7. A portion of each bridge portion 18, 19 extends below the skirt 15 as shown in FIG. 5. The construction of the bridge portions is disclosed and claimed in application Ser. No. 574,107 filed Jan. 26, 1984, filed concurrently herewith and having a common assignee with the present application, which is incorporated herein by reference.

Figure 4:
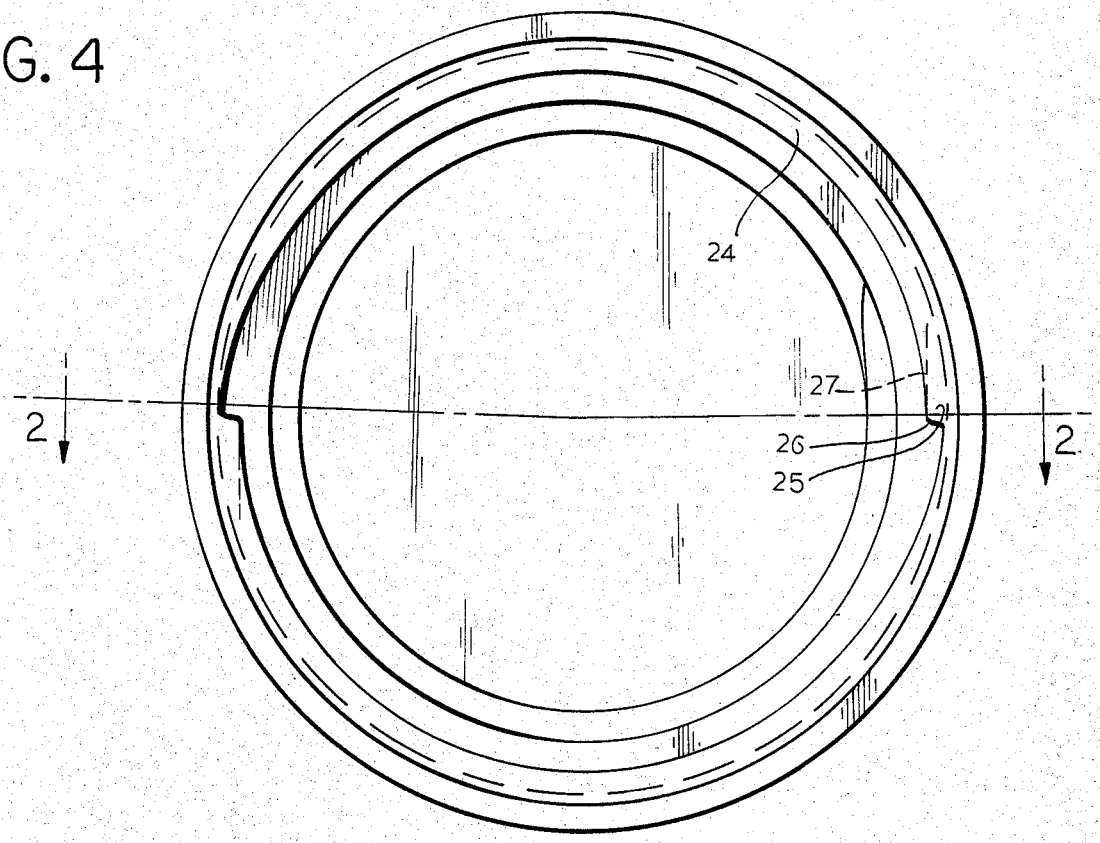
FIG. 4 is a bottom plan view of the closure.
Figure 8:
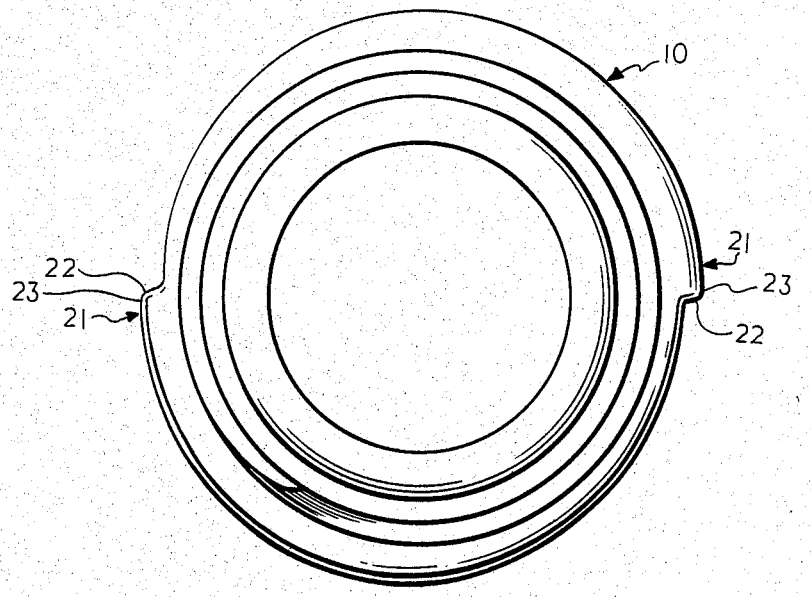
FIG. 8 is a top plan view of a portion of the container.
Figure 9:
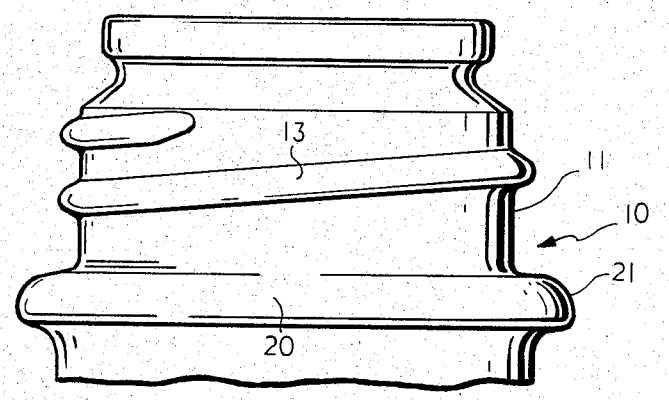
FIG. 9 is a side elevational view of a portion of the container.

The container 10 is formed with an annular bead 20 having at least one and preferably a plurality of circumferentially spaced radially outwardly extending projections 21 (FIGS. 8, 9) each of which defines a shoulder surface 22 and an inclined circumferential surface 23. The tamper indicating band 17 is formed with a radially inwardly extending bead 24 having complimentary lugs 25 including a stop or radial surface 26 and in a circumferentially inclined surface 27 (FIG. 4).

When the closure 11 is threaded on the container 10, the radial bead 24 on the tamper indicating band 17 engages the annular bead 20 on the container 10 and as the closure 11 is threaded to final position, the lugs 25 on the band 17 snap over the radially extending projections 21 on the annular bead 20 of the container 10 and past the projections 21. When the closure 11 is unthreaded, the radial surface 26 on the lugs 25 of the band 17 engage the complementary surfaces 22 on the projections 21 and immediately apply a shear force shearing the bridge portions 18, 19. The nature of the force applied permits the bridge portions 18, 19 to be made larger than normal. This not only provides a strong force to prevent breaking of the bridge portions during threading of the closure onto the container, but in addition, makes the closure easier to manufacture, since the plastic will flow more easily in the larger cross section of the bridges. On the other hand, the shear force is sufficient to deter children. The control of small dimensions on the bridges is obviated and therefore an overall better quality closure can be produced.

A further advantage of the construction is that the application of an immediate shear force on the bridge portions due to the interengagement of the shoulder surfaces 22 and stop surfaces 25 permits the tamper indicating band to be removed or severed from the remainder of the closure before substantial unsealing of the top wall 14 with the end of the neck 12 of the container. This insures that the seal will not be lost by slight rotation of the closure 11 which might be insufficient to sever the tamper indicating band but sufficient to break the seal and expose the contents.

We claim:

1. A tamper indicating package comprising a container having a body portion and a neck portion, said neck portion having external threads thereon, a plastic closure having a top wall and a peripheral skirt, said skirt having internal threads adapted to engage the threads on the neck of the container, a tamper indicating band extending downwardly from said skirt, said band having a greater diameter than the skirt of the closure, an integral weakened portion interconnecting said band to said skirt comprising a plurality of circumferentially spaced integral bridge portions, said container having an annular bead spaced below the threads on the neck, said band surrounding said annular bead having a radially inwardly extending bead adapted to engage the annular bead on the container when the closure is threaded on the container, said annular bead on said container and said radial bead on said tamper indicating band having interengaging means which are operable during unthreading of the closure to shear the bridge portions, said interengaging means comprising at least one projection on said bead on said container extending radially outwardly from said bead and defining a shoulder and at least one lug on said bead of said tamper indicating band extending radially inwardly and engageable with said shoulder when the closure is on the container.

2. The tamper indicating package set forth in claim 1 wherein said lug includes a complementary shoulder.

3. The tamper indicating package set forth in claim 2 wherein said projection on said container includes a circumferentially radially outwardly extending inclined portion whereby when the closure is threaded on the container, the lug on the tamper indicating band rides along the inclined portion and passes over the projection and thereafter moves radially inwardly past the projection.

4. The tamper indicating package set forth in claim 3 wherein said lug includes an inclined surface extending circumferentially and radially inwardly for engagement with the inclined surface of said projection.

5. The tamper indicating package set forth in claim 4 wherein at least some of said bridge portions have a cross section in a circumferential direction which has a greater axial dimension than a circumferential dimension and others of said bridge portions have a cross section in a circumferential direction which has a greater circumferential direction than an axial dimension.

6. A tamper indicating closure for a container having a body portion and a neck portion having external threads thereon, said closure comprising a top wall and a peripheral skirt, said skirt having internal threads adapted to engage the threads on the neck of the container, a tamper indicating band extending downwardly from said skirt, said band having a greater diameter than the skirt of the closure, an integral weakened portion interconnecting said band to said skirt comprising a plurality of circumferentially spaced integral bridge portions, said container having an annular bead spaced below the threads on the neck, said band surrounding said annular bead having a radially inwardly extending bead adapted to engage the annular bead on the container when the closure is threaded on the container, said annular bead on said radial bead on said tamper indicating band having interengaging means for engaging a bead on the container which are operable during unthreading of the closure to shear the bridge portions, said interengaging means comprising at least one projection on said bead on said container extending radially outwardly from said bead and defining a shoulder and at least one lug on said bead of said tamper indicating band extending radialy inwardly and engageable with said shoulder.

7. The tamper indicating closure set forth in claim 6 wherein said lug includes a complementary shoulder adapted to engage a complementary shoulder on the container.

8. The tamper indicating package set forth in claim 7 wherein said closure is made of plastic material.

9. The tamper indicating closure set forth in claim 8 wherein said lug on said band of said closure includes a circumferentially extending and axially extending inclined surface adapted to engage and ride along an inclined surface on a projection on a container and ride along the inclined surface on the container and past the projection as the closure is applied to a container.

10. The tamper indicating closure set forth in claim 9 wherein at least some of said bridge portions have a cross section in a circumferential direction which has a greater axial dimension than a circumferential dimension and others of said bridge portions have a cross section in a circumferential direction which has a greater circumferential direction than an axial dimension.

* * * * *